US006726147B1

(12) United States Patent
Perini et al.

(10) Patent No.: US 6,726,147 B1
(45) Date of Patent: Apr. 27, 2004

(54) MULTI-FUNCTION ACTUATOR, AND METHOD OF OPERATING SAME

(75) Inventors: Richard J. Perini, Holland, NY (US); James K. Riedel, East Aurora, NY (US); Michael D. Wantuck, Cowlesville, NY (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 10/439,073

(22) Filed: May 15, 2003

(51) Int. Cl.[7] ..... F42B 10/14
(52) U.S. Cl. ..... 244/3.27; 244/75 R; 244/3.28
(58) Field of Search ..... 244/3.21, 3.22, 244/3.24–3.3, 52, 49, 87, 75 R

(56) References Cited

U.S. PATENT DOCUMENTS 5,806,791 A * 9/1998 Hatalsky et al. ..... 244/3.24
6,073,880 A * 6/2000 Voigt et al. ..... 244/3.28
6,186,443 B1 * 2/2001 Shaffer ..... 244/3.29

* cited by examiner

*Primary Examiner*—Galen L. Barefoot
(74) *Attorney, Agent, or Firm*—Phillips Lytle LLP

(57) ABSTRACT

The improved multi-function actuator (20) broadly includes; a first mechanism (21) capable of bi-directional displacement; a motor (22) operatively arranged to selectively displace the first mechanism through a first displacement range; a second mechanism (24) capable of uni-directional displacement from a first position to a second position; a spring (25) operatively arranged to urge the second mechanism to move from the first position to the second position; a release mechanism (26) operatively arranged to release the spring when the first mechanism is moved beyond the first displacement range; a third mechanism (27) capable of bi-directional displacement; and a clutch (28) operated by the release of the spring to selectively disconnect the motor from the first mechanism and to selectively connect the motor to the third mechanism; whereby the motor may be operated to selectively control either the first mechanism or the third mechanism.

18 Claims, 3 Drawing Sheets

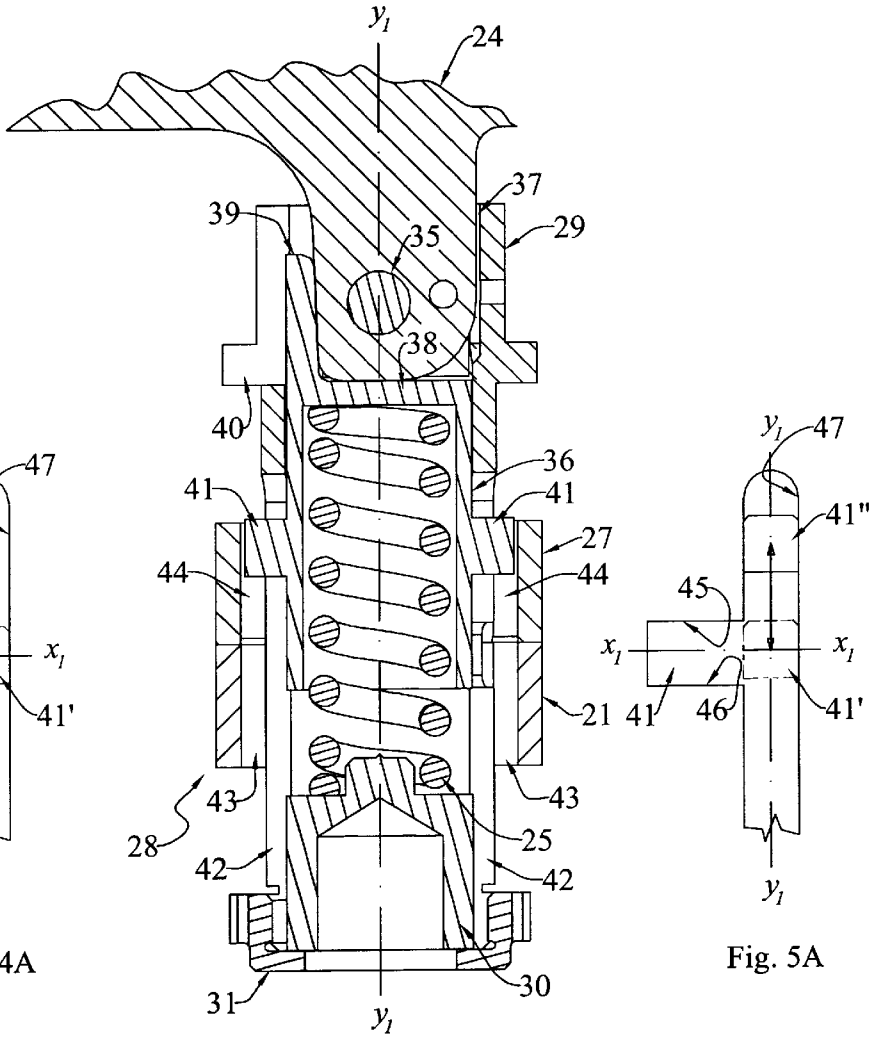
Fig. 5A
Fig. 5
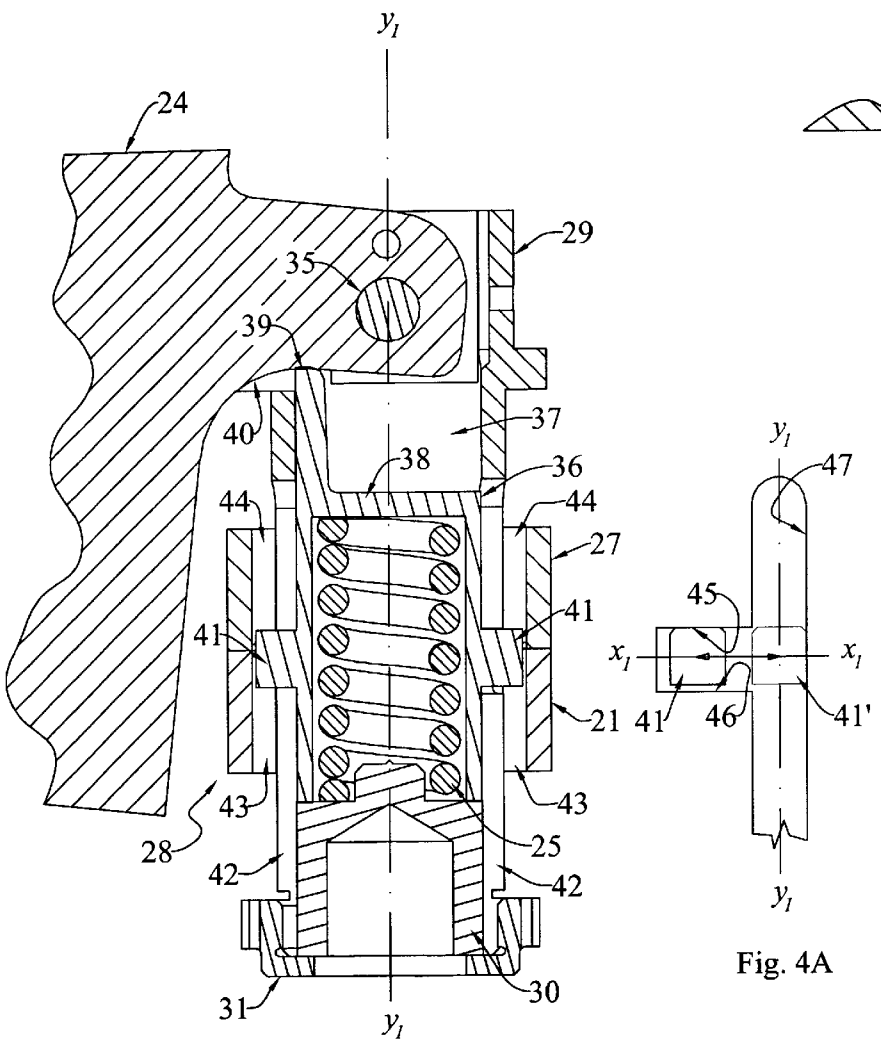
Fig. 4A
Fig. 4

MULTI-FUNCTION ACTUATOR, AND METHOD OF OPERATING SAME

TECHNICAL FIELD

The present invention relates generally to an improved multi-function actuator having a motor that is operatively arranged to initially displace a first mechanism (e.g., a first crank controlling the displacement of a thrust vector control vane) through a first displacement range, having a second mechanism (e.g., an aerodynamic steering fin) that is capable of spring-driven uni-directional displacement from a first (e.g., stowed) position to a second (e.g., deployed) position when the first mechanism is moved beyond such first displacement range; and having a clutch operated by the release of the spring to selectively disconnect the motor from the first mechanism and to selectively connect it to a third mechanism (e.g., a second crank controlling the angle-of-attack of the deployed fin) such that the motor may be operated to selectively control the third mechanism.

BACKGROUND ART

In certain applications, a missile is initially controlled by means of a thrust vector control vane positioned in the rocket jet stream. After launch, it may be desirable to deploy steering fins that have been stowed within the missile body, and to thereafter control the angle-of-attack of these fins to control the flight of the missile.

One might intuitively think that a first motor would be used to control movement of the thrust vector control vane, a second motor would be used to control the deployment of the fins, and a third motor would be used to control the angle-of-attack of the deployed fins. However, use of multiple actuators to control these three functions would add unnecessary weight and complexity to the missile, and would reduce its potential payload.

U.S. Pat. No. 4,709,877 discloses a mechanism having one motor for deploying a fin from a stowed position to a deployed position, and then for controlling the angle-of-attack of the deployed fin. According to this patent, the motor rotates a gear mounted on an initially-fixed support member to first perform the deployment function. Completion of this initial motion releases a spring-loaded pin to lock the fin in its deployed position, and also releases the support member so that further rotation of the gear may be used to control the angle-of-attack of the deployed fin.

It would be generally desirable to provide an improved multi-function actuator having a single motor that is capable of: (1) initially controlling a thrust vector control vane of a rocket motor, (2) releasing the fins so that they may be moved from their stored positions to their outwardly-extended deployed positions, and (3) thereafter controlling the angle-of-attack of these deployed fins within the air stream.

DISCLOSURE OF THE INVENTION

With parenthetical reference to the corresponding parts, portions or surfaces of the disclosed embodiment, merely for purposes of illustration and not by way of limitation, the present invention broadly provides an improved multi-function actuator (20), and method of operating same.

The improved actuator broadly includes: a first mechanism (21) capable of bi-directional displacement; a motor (22) operatively arranged to selectively displace the first mechanism through a first displacement range; a second mechanism (24) capable of uni-directional displacement from a first position to a second position; a spring (25) operatively arranged to urge the second mechanism to move from the first position to the second position; a release mechanism (26) operatively arranged to release the spring when the first mechanism is moved beyond the first displacement range; a third mechanism (27) capable of bi-directional displacement; and a clutch (28) operated by the release of the spring to selectively disconnect the motor from the first mechanism and to selectively connect the motor to the third mechanism; whereby the motor may be operated to sequentially control the displacement of the first mechanism, the displacement of the second mechanism, and the displacement of the third mechanism.

The first, second and third mechanisms may be arranged to operate corresponding first, second and third mechanical functions. The first mechanism may be operatively arranged to rotate a thrust vector control vane. The second mechanism may be operatively arranged to control the deployment of an aerodynamic control fin. The third mechanism may be operatively arranged to control the angle-of-attack of an aerodynamic control fin.

The first mechanism may be rotatable about a first axis ($y_1$-$y_1$), and may include a first crank (21). The first mechanism may be operatively arranged to control a thrust vector control vane (34). The third mechanism may includes a second crank (27). The motor may be arranged to drive the second crank through a screw (23). The clutch may be arranged to act between the first and second cranks. The second mechanism may include a cam driver (39) and wherein a mating cam surface (40) is located on the fin.

The release mechanism may include a lug (41) that is constrained to move in two orthogonal directions. More particularly, the lug may be constrained to move in one orthogonal direction (i.e., circumferentially) when the motor moves the first mechanism within the first displacement range and before the first mechanism has been moved beyond the first displacement range, and may be constrained to move in the other orthogonal direction (i.e., axially) after the first mechanism has been moved beyond the first displacement range.

The third mechanism may include a shaft 29 rotatable about a first axis. The clutch may initially couple the first and second cranks before such spring release, but may connect the third mechanism shaft to the second crank after such spring release.

The improved method broadly includes the steps of: providing a first mechanism capable of bi-directional displacement; providing a motor that is operatively arranged to selectively displace the first mechanism through a first displacement range; providing a second mechanism that is capable of uni-directional displacement from a first position to a second position; providing a spring that is operatively arranged to urge the second mechanism to move from the first position to the second position; releasing the spring when the first mechanism is moved beyond the first displacement range; providing a third mechanism that is capable of bi-directional displacement; and disconnecting the motor from the first mechanism in response to release of the spring, and connecting the motor to the third mechanism in response to release of the spring; thereby to cause the motor to sequentially control the displacement of said first mechanism, the displacement of said second mechanism, and the displacement of said third mechanism.

Accordingly, the general object of the invention is to provide an improved multi-function actuator.

Another object is to provide an improved multi-function actuator having a motor that is operatively arranged to initially control displacement of a first mechanism within a first displacement range, to allow a second mechanism to be released from a first position to a second position when the first mechanism is moved beyond the first displacement range; and to thereafter selectively disconnect the motor from the first mechanism and to selectively connect the motor to a third mechanism such that the motor may be operated to selectively control either the first mechanism or the third mechanism.

Still another object is to provide an improved method of controlling the operation of a multi-function actuator.

These and other objects and advantages will become apparent from the foregoing and ongoing written specification, the drawings and the appended claims.

BRIEF DESCRIPTION OF THE DRAWINGS

FIG. 4 is a fragmentary sectional view thereof, taken generally on line 4—4 of FIG. 2, showing fin-deployment device when the fin is in its stowed position.

FIG. 4A is a profile cartoon showing the lug as being moved within the horizontal slot, and showing the lug as having been moved into the vertical slot when the fin is about to be deployed.

FIG. 5 is a fragmentary sectional view thereof, taken generally on line 5—5 of FIG. 3, showing the fin-deployment device when the fin is in its deployed position.

FIG. 5A is a profile cartoon showing the lug as having moved upwardly in the vertical slot when the fin has been deployed.

DESCRIPTION OF THE PREFERRED EMBODIMENTS

Figure 1:
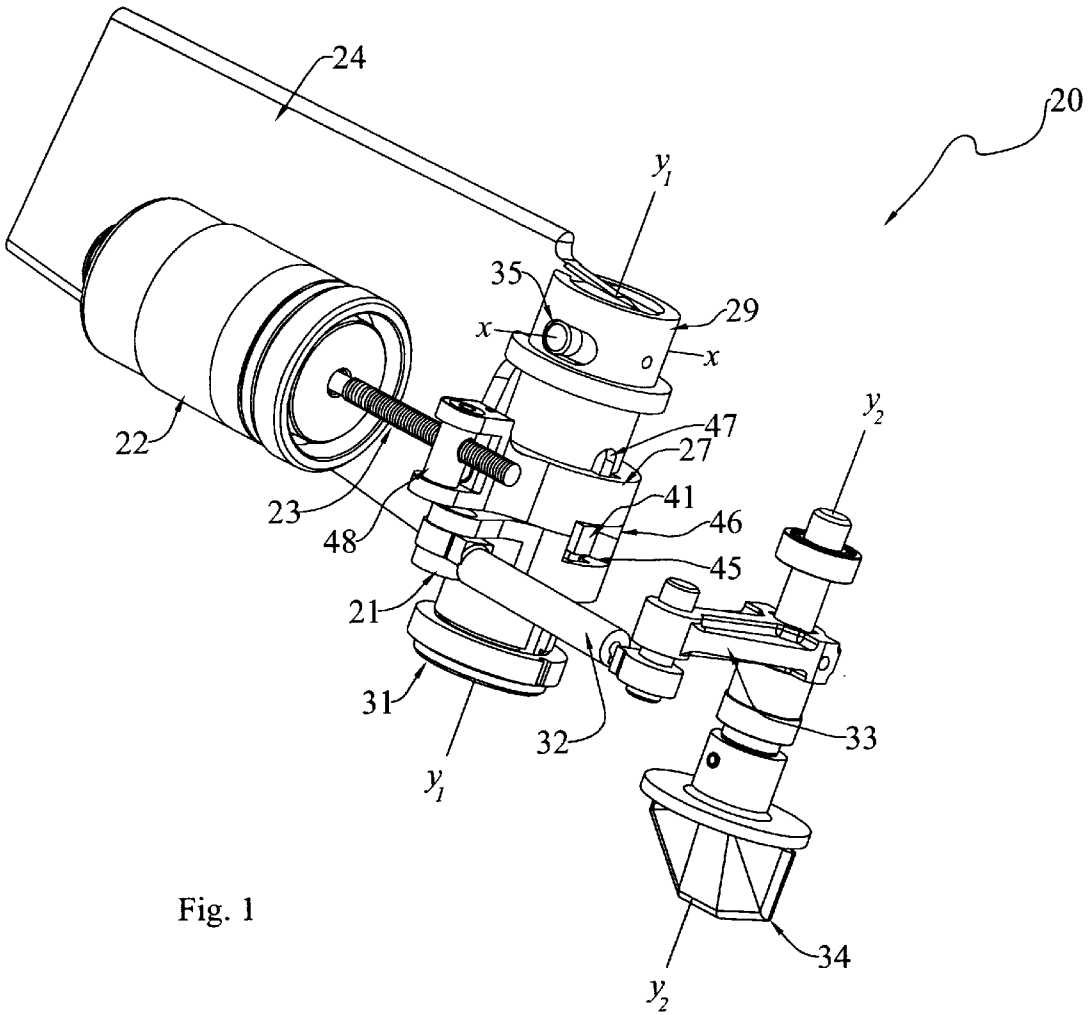
FIG. 1 is a perspective view of a first form of the improved multi-function actuator, this view showing the motor driving the first crank, the mechanism for selectively coupling the first crank to the second crank or to the shaft, and depicting a fin carried on the shaft as being in its stored out-of-the-way position.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure normally faces the reader. Similarly, the terms "inwardly" and "outwardly" generally refer to the orientation of a surface relative to its axis of elongation, or axis of rotation, as appropriate.

Referring now to the drawings, and, more particularly, to FIG. 1 thereof, the present invention broadly provides an improved multi-function actuator, of which the presently-preferred embodiment is generally indicated at 20.

The improved actuator broadly includes a first mechanism, such as a first crank 21; a motor 22 having a rotatable threaded output shaft 23; a second mechanism 24; a spring 25 (FIGS. 2–5); a release mechanism, generally indicated at 26 in FIGS. 4A and 5A; a third mechanism 27; and a clutch, generally indicated at 28 in FIGS. 4 and 5.

The first mechanism 21 is shown as being a crank that is mounted for rotation about a tubular first shaft 29. This first shaft is shown as being elongated along axis $y_1$-$y_1$. The lower end of the shaft is closed by means of a cylindrical plug 30 and a lowermost end cap member 31 that is threaded onto the lower marginal end portion of the first shaft. As best shown in FIG. 1, a connecting rod 32 has one end pivotally connected to the crank 21 at a location eccentric to axis $y_1$-$y_1$, and has its opposite end pivotally connected to a third crank 33. Third crank 33 is mounted for rotation about an axis $y_2$-$y_2$, which is shown as being substantially parallel to axis $y_1$-$y_1$. A thrust vector control vane 34 is mounted on the lower end of third crank 33, and is arranged to be positioned in the jet of a rocket motor (not shown). Thus, the first mechanism (i.e., first crank 21) is mounted for bi-directional angular displacement within a first displacement range about axis $y_1$-$y_1$. Such movement of the first mechanism is initially used to control the position of the thrust vector control vane in the referred embodiment.

Figure 3:
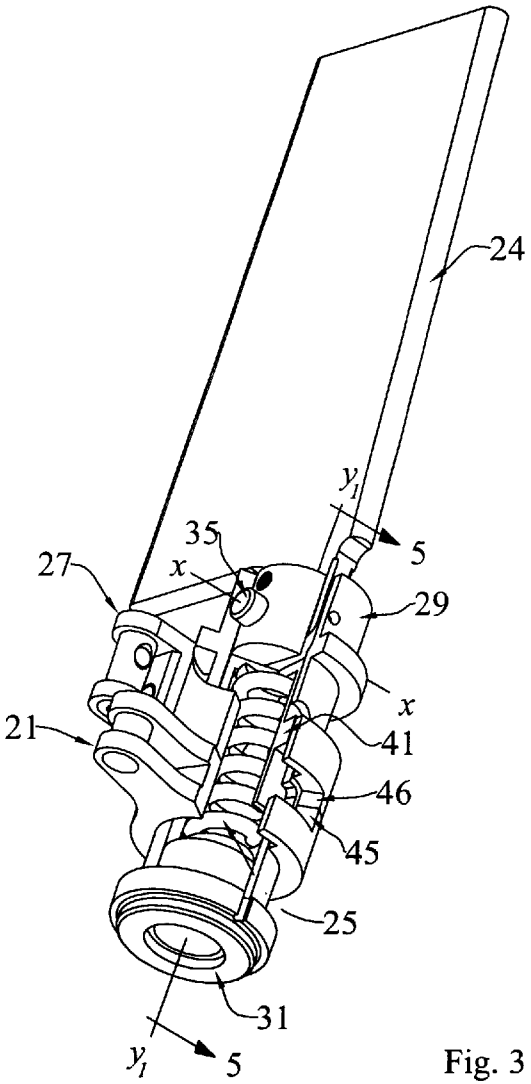
FIG. 3 is a perspective view of the mechanism shown in FIG. 2, but showing the fin as having been moved to its outwardly-extending deployed position.
Figure 2:
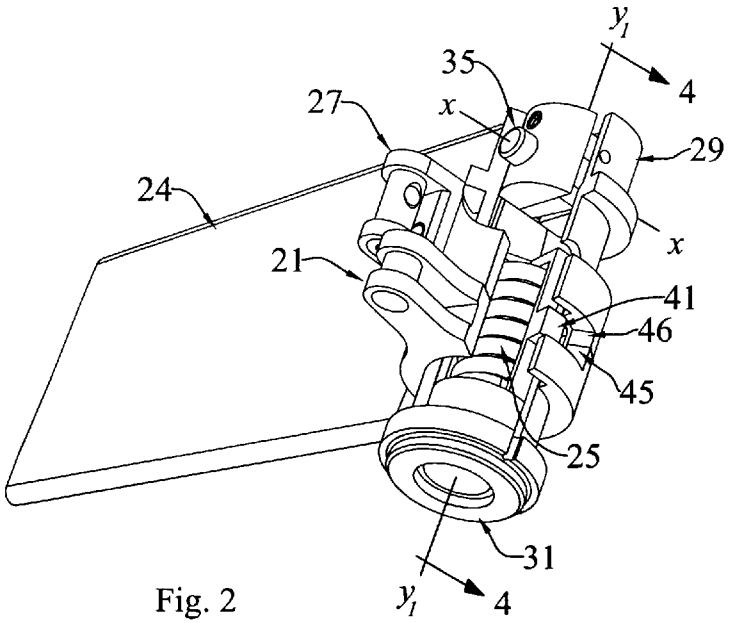
FIG. 2 is a perspective view, albeit from a different angle, of the mechanism shown in FIG. 1, with the motor, connecting rod, and vane control mechanism omitted in the interest of clarity, and with portions of the yoke member cut away to reveal the fin-deployment device therewithin, this view showing the fin as being in its stowed out-of-the-way position.

The second mechanism 24 is shown as being an aerodynamic steering fin which is movable between a first or stowed position (i.e., as shown in FIGS. 1, 2 and 4), and a second or deployed position (i.e., as shown in FIGS. 3 and 5). More particularly, fin 24 is mounted on the upper portion of the first shaft via a pin 35 having a diametrical axis x-x which is transverse to the longitudinal axis yhd 1-$y_1$.

As best shown in FIGS. 4 and 5, a cam driver, generally indicated at 36 is operatively arranged inside first shaft 29 for axial movement therealong. Cam driver 36 is shown as having an upper recess 37 extending downwardly into the cam driver and terminating in an intermediate transverse wall 38 at the both of the recess, an uppermost cam surface 39 which is operatively arranged to bear against a cam surface 40 provided on the fin.

Spring 25 is compressed between plug 30 that closes the lower end of first shaft 29, and cam driver wall 38. The spring is compressed, and continuously urges the cam driver to move upwardly within the first shaft so as to maintain cam driver surface 39 in contact with fin cam surface 40 when the fin is in its stowed position (as shown in FIG. 4) when the fin moves outwardly to its deployed position, the marginal portion of the fin about pin 35 will be received in driver recess 37, as shown in FIG. 5.

The cam driver is also shown as having a pair of diametrically-opposite lugs, severally indicated at 41, that extend radially outwardly through diametrically-opposite vertically-elongated slots, severally indicated at 42, provided in the first shaft. These lugs are further received in keyways 43, 44 of the first and second cranks 21, 27, respectively. As best shown in FIGS. 1–3, the two cranks have complementary transverse slots 45, 46 respectively.

Lugs 41, 41 are arranged in these transverse slots for movement in one orthogonal (i.e., circumferential) direction. Thus, the first crank is operatively arranged for bi-directional angular displacement within the substantial length of circumferential slots 45, 46.

As best shown in FIGS. 4A and 4B, the release mechanism 26 comprises axial slots 47, 47, which intersect circumferential slots 45, 46. In other words, the first member may be moved to a position beyond its first displacement range such that lug 40 is completely positioned in the alternative position indicated by reference numeral 41' in FIG. 4. Once so aligned, as spring 25 may quickly move the cam driver upwardly moving the lugs from position 41' to position 41" (FIG. 5A) within the first shaft, thereby rotating the fin from its stowed position to its deployed position.

The third mechanism (i.e., second crank 27) is also mounted on the first shaft for rotation about shaft axis $y_1$-$y_1$. Second crank 27 is connected to threaded motor output shaft 23 via a swivel nut 48. When spring 25 expands such that the lugs 41, 41 move upwardly and wholly within the second crank, the first crank 21 is effectively uncoupled from the motor. Thus, clutch 29 includes lugs 41, 41 and the keyways 43, 44 of the first and third mechanisms 21, 27, respectively. As shown in FIG. 4, when the first mechanism is initially moved in either direction within its first displacement range, as represented by the movement of lugs 41 within cooperatively-aligned slots 45, 46, the first and third cranks are effectively coupled to one another. However, when the lugs move to position 41' and thereafter move longitudinally within slot 47 to position 41", the lugs will thereafter be arranged wholly within keyway 44, and no longer with keyway 43. This will effectively uncouple the first mechanism from the motor, and couple the third mechanism to the motor.

Therefore, the invention broadly provides an improved multi-function actuator, which broadly includes a first mechanism (e.g., first crank 21) capable of bi-directional movement (as permitted by cooperative slots 45, 46), a motor (22) operatively arranged to selectively displace the first mechanism through a first displacement range; a second mechanism (e.g., fin 24) capable of uni-directional displacement from a first (e.g., stowed) position to a second (e.g., deployed) position; a spring (25) operatively arranged to urge the second mechanism to move from the first position to the second position; a release mechanism 26 (e.g., the movement of lugs 41 in circumferential slots 45, 46 to alternative position 41") operatively arranged to release the spring when the mechanism is moved beyond its first displacement range; a third mechanism (e.g., second crank 27) capable of bi-directional displacement (e.g., shown to be circumferential in the preferred embodiment); and a clutch (29) operated by the release of the spring to selectively disconnect the motor from the first mechanism and to selectively connect the motor to the third mechanism; such that the motor may be selectively operated to control either the first mechanism or the third mechanism.

In use, the invention provides an improved method of operating a multi-function actuator. This method broadly includes the steps of: providing a first mechanism capable of bi-directional displacement; providing a motor that is operatively arranged to displace the first mechanism through a first displacement range; providing a second mechanism that is capable of uni-directional displacement from a first position to a second position; providing a spring that is operatively arranged to urge the second mechanism to move from the first position to the second position; releasing the spring when the first mechanism is moved beyond the first displacement range; providing a third mechanism that is capable of bi-directional displacement; and disconnecting the motor from the first mechanism in response to release of the spring and connecting the motor to the third mechanism in response to the spring; thereby to cause the motor to selectively control either the first or third mechanisms.

Modifications

The present invention contemplates that many changes and modifications may be made. For example, while it is presently preferred to use a spring or other resilient member to bias the fins to move outwardly toward their deployed positions, other types of mechanisms could alternative be employed. As indicated above, the first function may be control of the thrust vector control vane, and the second function may be release of a spring-biased fin and/or control of the angle-of-attack of the deployed fins. Other types of functions (e.g., initial orientation of an antenna mount on a satellite; antenna- or fin-locking, rather than fin deployment; erection of the antenna relative to the mount, and subsequent orientation of the antenna, etc.) might alternatively be controlled.

Therefore, while the presently preferred form of the improved multi-function actuator has been shown and described, a person skilled in this art will readily appreciate that various additional changes and modifications may be made without departing from the spirit of the invention, as defined and differentiated by the following claims.

What is claimed is:

1. A multi-function actuator, comprising:

a first mechanism capable of bi-directional displacement;

a motor operatively arranged to selectively displace said first mechanism through a first displacement range;

a second mechanism capable of uni-directional displacement from a first position to a second position;

a spring operatively arranged to urge said second mechanism to move from said first position to said second position;

a release mechanism operatively arranged to release said spring when said first mechanism is moved beyond said first displacement range;

a third mechanism capable of bi-directional displacement; and a clutch operated by the release of said spring to selectively disconnect said motor from said first mechanism and to selectively connect said motor to said third mechanism;

whereby said motor may be operated to sequentially control the displacement of said first mechanism, the displacement of said second mechanism, and the displacement of said third mechanism.

2. A multi-function actuator as set forth in claim 1 wherein said first, second and third mechanisms are arranged to operate corresponding first, second and third mechanical functions.

3. A multi-function actuator as set forth in claim 2 wherein said first mechanical function is control of thrust vector control vane.

4. A multi-function actuator as set forth in claim 2 wherein said second mechanical function is control of the deployment of an aerodynamic control fin.

5. A multi-function actuator as set forth in claim 2 wherein said third function is control of the angle-of-attack of an aerodynamic control fin.

6. A multi-function actuator as set forth in claim 1 wherein said first mechanism is rotatable about a first axis.

7. A multi-function actuator as set forth in claim 6 wherein said first mechanism includes a first crank.

8. A multi-function actuator as set forth in claim 7 wherein said third mechanism includes a second crank.

9. A multi-function actuator as set forth in claim 8 wherein said motor is arranged to drive said second crank through a screw.

10. A multi-function actuator as set forth in claim 8 wherein said clutch is arranged to act between said first and second cranks.

11. A multi-function actuator as set forth in claim 4 wherein said second mechanism includes a cam driver and wherein a mating cam surface is located on said fin.

12. A multi-function actuator as set forth in claim 1 wherein said release mechanism includes a lug that is constrained to move in two orthogonal directions.

13. A multi-function actuator as set forth in claim 12 wherein said lug is constrained to move in one orthogonal direction when said motor moves said first mechanism within said first displacement range and before said first mechanism has been moved beyond said first displacement range.

14. A multi-function actuator as set forth in claim 13 wherein said lug is constrained to move in the other orthogonal direction after said first mechanism has been moved beyond said first displacement range.

15. A multi-function actuator as set forth in claim 1 wherein said third mechanism includes a shaft rotatable about a first axis.

16. A multi-function actuator as set forth in claim 15 wherein said clutch initially couples said first and second cranks before such spring release.

17. A multi-function actuator as set forth in claim 16 wherein said clutch connects said third mechanism shaft to said second crank after such spring release.

18. The method of operating a multi-function actuator, comprising the steps of:

providing a first mechanism capable of bi-directional displacement;

providing a motor that is operatively arranged to selectively displace said first mechanism through a first displacement range;

providing a second mechanism that is capable of uni-directional displacement from a first position to a second position;

providing a spring that is operatively arranged to urge said second mechanism to move from said first position to said second position;

releasing said spring when said first mechanism is moved beyond said first displacement range;

providing a third mechanism that is capable of bi-directional displacement; and disconnecting said motor from said first mechanism in response to release of said spring, and connecting said motor to said third mechanism in response to release of said spring;

thereby to cause said motor to sequentially control the displacement of said first mechanism, the displacement of said second mechanism, and the displacement of said third mechanism.

* * * * *